United States Patent [19]

Bagnall

[11] Patent Number: 4,653,413

[45] Date of Patent: Mar. 31, 1987

[54] TUFTING MACHINE NEEDLE BAR DRIVE

[75] Inventor: Arthur Bagnall, Whitefield, England

[73] Assignee: Spencer Wright Industries, Inc., Chattanooga, Tenn.

[21] Appl. No.: 851,341

[22] Filed: Apr. 14, 1986

[30] Foreign Application Priority Data

Jul. 19, 1985 [GB] United Kingdom ..... 8518270

[51] Int. Cl.[4] ..... D05C 15/30

[52] U.S. Cl. ..... 112/80.41

[58] Field of Search ..... 112/80.41, 80.32

[56] References Cited

U.S. PATENT DOCUMENTS

| | | | |
|---|---|---|---|
| 4,392,440 | 7/1983 | Ingram | 112/80.41 |
| 4,465,001 | 8/1984 | Ingram | 112/80.41 |
| 4,483,260 | 11/1984 | Gallant | 112/80.41 |
| 4,501,212 | 2/1985 | Slattery | 112/80.41 |

*Primary Examiner*—Ronald Feldbaum

*Attorney, Agent, or Firm*—Alan Ruderman

[57] ABSTRACT

A tufting machine has a needle bar shifter for moving the needle bar transversely of the direction of the movement of the backing fabric, a pattern cam determining the amount and frequency of the shifts. The cam is driven in timed relationship with the reciprocation of the needle bar at a cyclically variable speed. The drive for the cam includes an epicyclic gear arrangement having a constant speed input motion applied to the ring gear and an oscillatory motion applied to the planet gears. The output is taken at the sun gear and applied to the pattern cam. The same drive may also be used for driving the feed rollers to feed the base material at a cyclically variable speed when the needles are above the base material.

18 Claims, 6 Drawing Figures

TUFTING MACHINE NEEDLE BAR DRIVE

BACKGROUND OF THE INVENTION

This invention relates to tufting machines and more particularly to apparatus for driving the pattern cam used for effecting longitudinal displacement of the needle bar of a tufting machine to extend the capabilities thereof.

In the production of tufted fabric it is known to jog or shift the needle bar in its longitudinal direction transversely across the tufting machine relatively to the base material in order to create various pattern effects, to break up the unattractive alignment of the longitudinal rows of tufts and to reduce the affects of streaking which results from variations and colorations of the yarn.

Various devices have been proposed and are in use for controllably applying a step-wise force to the needle bar of the tufting machine in accordance with a pattern. Such needle shifting or stitch placement drives conventionally fall into two categories. The first category is that of the cam driven type whereby a rotating plate cam, driven directly from the tufting machine mainshaft, is drivingly engaged with the needle bar so as to effect the required displacement thereof. The second category is that of the programmable type which may be hydraulically or pneumatically driven, or driven mechanically through some form of programmable indexing device whereby a ram is drivingly engaged with the needle bar so as to effect the required displacement thereof. Examples of such drives are illustrated in U.S. Pat. Nos. 3,964,408 and 3,972,295, which utilize pawl and ratchet devices, U.S. Pat. Nos. 4,010,700 and 4,392,440 which utilize indexing devices and 4,173,192 which uses a hydraulic actuator.

Because of the greater reliability, simplicity and lower cost of a cam drive system, a cam driven needle bar shifter remains the primary drive for supplying the controlled step-wise force to the needle bar in accordance with the information on the periphery of the pattern cam. Examples of such needle shifting devices are disclosed in U.S. Pat. Nos. 3,016,380; 3,934,524 and 4,445,447.

In the conventional cam driven needle bar shifter apparatus, the cam acts on cam followers connected through drive rods and the like to the needle bar and the cam is rotatably driven through proper reduction apparatus from the mainshaft of the tufting machine and rotates at a constant speed in synchronism with the operation of the needles and the hooks or loopers. The cam serves to drive the needle bar in its longitudinal direction during that portion of the machine cycle when the needles are above and out of engagement with the backing material in which the stitches are to be formed so as to avoid interference between the needles and the needle plate. This occurs during only a small portion of the cam circumference so that only this portion of the cam circumference is available for controlling the needle bar movement while the remaining portion of the cam circumference is of a constant radius and non-effective and merely idles the needle bar in place. Thus, the number of needle bar movements for a given cam is limited, and the stitch pattern repeat is similarly restricted due to the relationship between the "dwell" time, i.e., the period within a machine cycle when the needles are engaged with the backing material and no longitudinal shift of the needle bar occurs, and the "displacement" time, when the needles are withdrawn from the backing and the needle bar is jogged.

Typically the needle bar is shifted or jogged laterally across the machine during approximately 120° to 180° of the needle bar reciprocation cycle so that the "displacement" time using a conventional cam driven shifter is approximately 33 percent to 50 percent of the machine cycle and of the circumference of the cam, with the remaining 50 to 67 percent of the cam circumference and machine cycle being an idle surface or the "dwell" time. Thus, for a major part of its rotation the cam is precluded from effecting shifting of the needle bar. If the surface of the cam is divided into sectors equal in number to the number of stitches in the pattern, the angular distance from a point in one sector to a similarly disposed point in an adjacent sector is the angle the cam must rotate for each revolution of the tufting machine mainshaft and for each cycle of the needle bar. Because of this, and because of the small surface available for a follower to ride upon each sector of a practical sized cam, the number of sectors into which the cam may be divided, and hence the number of stitches in a pattern produced by the cam, is limited. Moreover, because of the small time available for needle bar displacement, coarse cam profiles must be utilized for the displacement step, thereby giving rise to problems of inertia in relation to the needle bar and militating against acurate and smooth needle bar movement. Because of the abrupt changes in the shape of the cam surface to produce the required abrupt directional reversals of the movement of the needle bar as the cam rotates, problems arise with regard to ensuring that the cam follower runs smoothly on the cam surface and it is difficult to achieve satisfactory pattern control in the case of high speed tufting machines. Additionally, the need for rapid transition between the "dwell" and "displacement" portions of the total cam profile require that cam followers of relatively small size be utilized, which in itself gives rise to further problems relating to dynamic reponse characteristics.

SUMMARY OF THE INVENTION

Consequently, a primary object of the present invention is to provide in a tufting machine a method and drive for moving various of the driven members of the machine in a cyclically manner while the needles of the machine are clear of the backing.

It is another object of the present invention to provide a tufting machine having a cam driven transversely shiftable needle bar, the cam being driven in a cyclically variable manner.

It is a further object of the present invention to drive a pattern cam of a tufting machine needle bar shifter by means of a drive mechanism having multiple inputs respectively comprising a constant speed input and an oscillating motion input superimposed thereon to give a cyclically variable drive to the cam thereby to minimize the angular velocity of the cam while the needles are engaged with the backing material so that only a minor portion of the cam profile is necessary for the "dwell" and the major portion of the cam profile is available for the "displacement" portions of the machine cycle.

It is a still further object of the present invention to provide a drive mechanism for a cam of a tufting machine needle bar shifting apparatus, the drive mechanism having an epicyclic gear arrangement in which a constant speed input is applied to one portion thereof and an oscillatory motion input is simultaneously applied to another portion thereof and combined so that the output for driving the cam is the resultant of the inputs.

It is yet a still further object of the present invention to provide a drive mechanism for driving the pattern cam of a tufting machine needle bar shifting apparatus, the drive including an epicyclic gear arrangement having a constant speed input applied to the ring gear and an oscillatory motion applied to the planet gears, and having an output derived from the sun gear thereof for driving the cam.

Accordingly, in its broadest aspect the present invention provides in a tufting machine, a drive mechanism having multiple inputs respectively comprising a constant speed input and an oscillating motion input superimposed thereon to give a cyclically variable drive output, the inputs and the output being in timed relationship with the stitch forming instrumentalities of the tufting machine.

In the preferred form of the invention the constant speed input and the oscillatory motion input are simultaneously applied to and are combined by an epicyclic gear arrangement, the constant speed input being applied to the ring gear of the epicyclic gear arrangement and the oscillatory motion being applied to the planetary gearing carrier, while the drive output is taken from the sun gear. The output from the sun gear preferably is applied to drive the pattern cam of a sliding needle bar drive system of the tufting machine.

An additional feature of the invention is the provision of apparatus for varying the oscillatory motion applied to the epicyclic gear arrangement. In a specific form the amplitude of oscillation applied to the planet gear carrier may be varied by an eccentric or crank drive, and this may be effected by means of a rotatable slide arm receiving a slide block adjustably disposed in the slot, the slide block being connected to a connecting rod which is operatively connected to apply the oscillatory motion to the planet gear carrier. This arrangement permits a particular cam to provide multiple needle bar shifting patterns and thus multiple stitch patterns merely by changing the position of the slide block and varying the ratio of the drives by changing certain of the drive members such as sprockets and the like.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
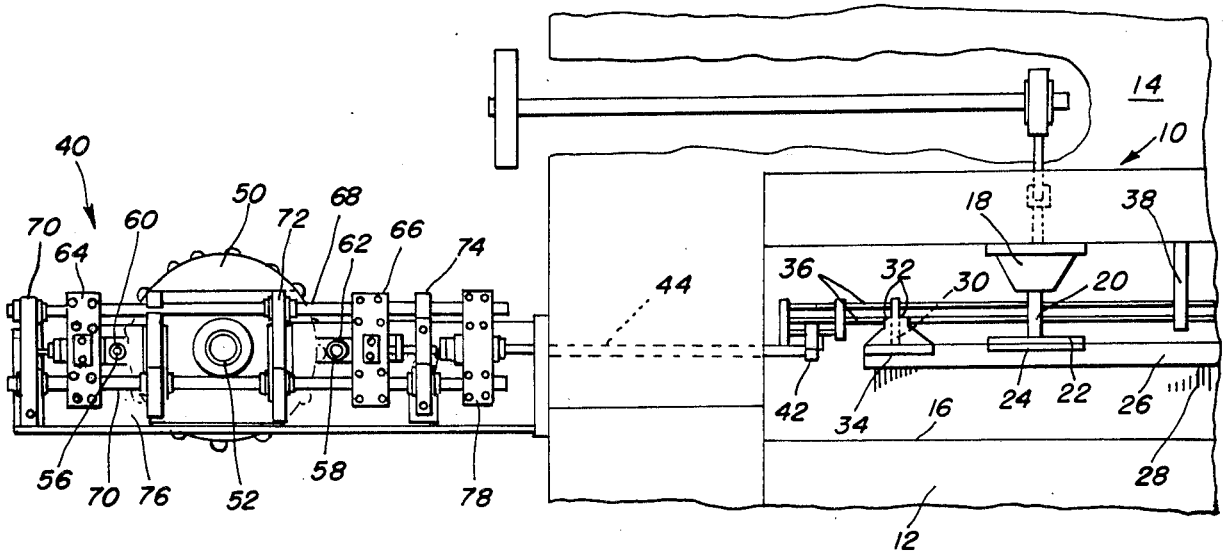
FIG. 1 is a fragmentary front elevational view of the tufting machine incorporating a cam driven needle bar shifting apparatus and a cam drive mechanism constructed in accordance with the principles of the present invention.
Figure 2:
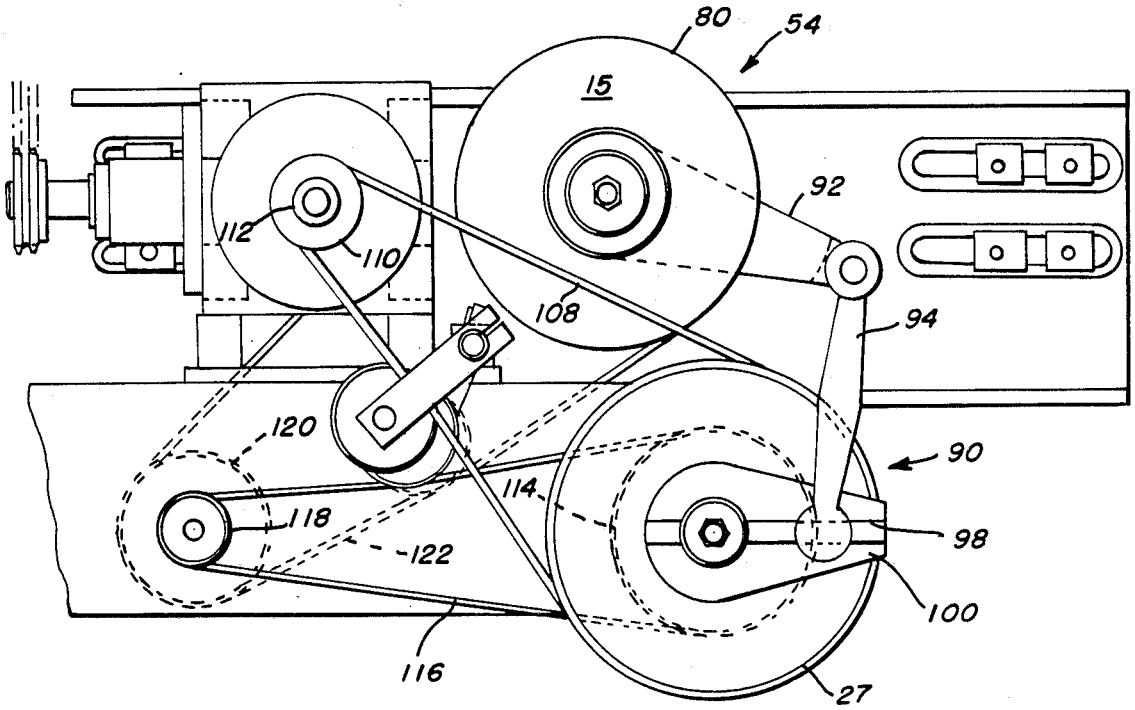
FIG. 2 is a front elevational view of the drive mechanism for driving the pattern cam of the shifting apparatus illustrated in FIG. 1.
Figure 3:
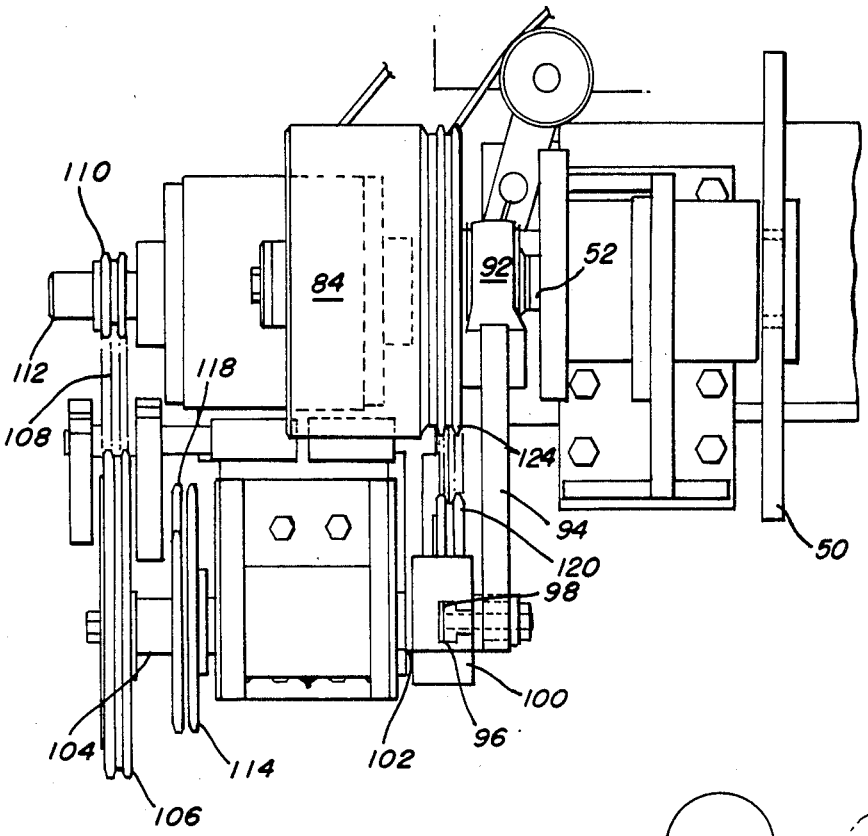
FIG. 3 is a side elevational view of the drive illustrated in FIG. 1.
Figure 4:
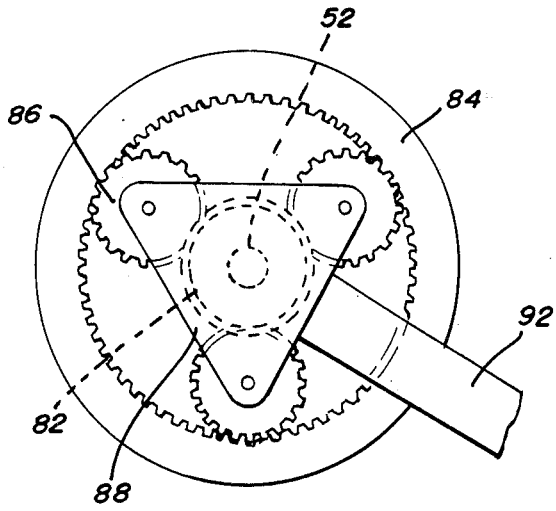
FIG. 4 is a diagrammatic representation of the epicyclic gear embodied within the drive mechanism.

Referring now to the drawings, FIG. 1 generally illustrates a portion of a tufting machine 10 having a frame comprising a base 12 and a head 14 disposed above the base. The base 12 includes a needle plate 16 over which backing material (not illustrated) is adapted to be fed by conventional means.

Mounted in the head 14 for vertical reciprocation within a respective bushing assembly 18 is one of a plurality of push rods 20 to the lower end of which a needle bar support foot 22 is carried. The support foot has a slideway within which a slide plate 24 is slidably received. A needle bar 26 is secured to the plate 24 and slidable longitudinally of the slideway transverse to the direction of movement of the backing material and conventionally reciprocably driven vertically by the action of the push rods. The needle bar 26 carries a plurality of needles 28 adapted to penetrate the backing material upon reciprocation of the needle bar to project loops of yarn therethrough as the push rods are reciprocated. The needles cooperate conventionally with loopers (not illustrated) mounted beneath the needle plate for seizing the loops of yarn presented by the needles and for releasing the loops to form loop pile or for holding the loops until cut by a knife cooperating with the loopers or hooks as is notoriously well known in the tufting art.

In order to drive the needle bar 26 selectively with controlled lateral movement, any member of the cam shifting apparatus of the prior art may be provided. Thus, the needle bar 26 may be provided with a number of upstanding plate members 30 which are straddled by a pair of rollers 32 rotatably mounted on mounting plates 34 secured to brackets (not illustrated) clamped to a pair of laterally extending slide rods 36. The slide rods may be journalled in brackets 38 fixed to the head 14 above the needle bar. At the end of the machine adjacent the needle bar shifting apparatus, generally illustrated at 40, the slide rods 36 are fastened to a clamping block 42 above the bed 12. A drive rod 44 is secured through the clamping block 42 and extends to the end housing 46 of the tufting machine head 14 toward the shifting apparatus 40 and journalled in the end wall 48 for lateral movement transversely relative to the backing material.

The shifting apparatus includes a pattern cam 50 mounted on a rotatable drive shaft 52. The drive shaft is driven by drive apparatus 54 as hereinafter described to rotate the cam 50. A pair of follower rollers 56, 58 act against the periphery of the cam 50 at substantially diametrically opposed locations. The followers 56, 58 may be pivotably mounted on brackets 60, 62 respectively fastened to clamping blocks 64, 66, each of which is clamped to a pair of spaced slide rods 68, 70 slidably disposed within linear bearings in bearing blocks 70, 72 and 74 secured to a fixed plate 76. Another clamping block 78 is secured to the rods 68, 70 adjacent the tufting machine end housing 46 and is fastened to the drive rod 44. Thus, as the cam 50 rotates and drives the followers 56, 58 the slide rods are driven linearly to transmit their motion to the drive rod 44 and thus to the needle bar to effect sliding motion thereof in accordance with the information on the periphery of the cam 50. A shifting apparatus of this type is disclosed in U.S. Pat. No. 4,465,001 assigned to the common assignee of the present invention.

The drive means 54 for effecting rotation of the control cam 50 of the needle bar shifting apparatus 40 includes an epicyclic gear device 80 comprising a sun gear 82 fixedly mounted on the output shaft 52 which carries the control cam 50 on one end thereof, or, of course the output shaft may be separate from the cam shaft but coupled thereto. The sun gear 82 is mounted within the annulus of an annular or ring gear 84 arranged coaxially and in radial alignment with the sun gear. A plurality of planet gears 86 are mounted intermediate and in mesh with the sun gear 82 and the ring gear 84, the planet gears 86 being carried by and rotatably mounted in a planet cage or carrier 88 which is freely moveable about the axis of the output shaft 52. The drive means 54 further includes an eccentric or crank 90 for driving the planet cage or carrier 88 with an oscillating motion.

A rocker arm 92 is fixedly secured to the cage or carrier 88 and may have its other end pivotably connected to an eccentric or crank drive to supply the oscillating motion to the planet cage 88. However, it may be preferable that the oscillating motion be adjustable so that the same cam 50 can be used for various patterning affects. To this end, an aspect of the present invention is to pivotably mount the end of the arm remote from the planet cage 88 to one end of a connecting rod 94 of the eccentric drive 90 while the other end of the rod 94 is pivotably fastened to a slide block 96 slidably disposed within a slot 98 of a rotatable slide arm 100, the slide block being adjustably secured within the slot at selective locations, thereby to change the amplitude of oscillation of the rocker arm 92. Should it prove to be desirable not to have the adjustable oscillation feature, the connecting rod 94 may merely be pivotably connected to the arm 100 without the expedient of the slide block and slide, or the rocker arm itself may be pivotably connected to such a non-adjustable crank provided by the arm 100 or the like.

The arm 100, or other such eccentric drive member, is rotatable in timed relationship with the ring gear 84 of the epicyclic gear device, and to this end is mounted on a shaft 102 which is coupled to a shaft 104 and which in turn carries a sprocket gear or pulley 106, the sprocket or pulley 106 being driven by means of a chain or drive belt 108 from another sprocket or pulley 110 mounted on a shaft 112, the latter being operatively connected to and driven in timed relationship with the main shaft of the tufting machine and thus in timed relationship with the reciprocation of the needle bar 26. Another sprocket gear or pulley 114 is also mounted on the shaft 104 on which the sprocket or pulley 106 is secured and drivingly connected by means of a chain or drive belt 116 to a sprocket or pulley 118 which is mounted coaxially on a common shaft with another sprocket or pulley 120. The sprocket or pulley 120 is drivingly connected by means of a chain or drive belt 122 to another sprocket or pulley 124 secured to the ring gear 84.

The eccentric drive 90 thus serves to transmit an oscillatory motion to the sun gear 82 via the rocker arm 92 from the motion of the slide arm 100, which motion is superimposed upon the constant motion applied to the sun gear 82 from the ring gear 84 through the planet gears 86, thus to give a cyclically variable drive to the output shaft 52 on which the sun gear 82 is mounted. Consequently, the pattern cam 50 is rotated at a cyclically varied rate during each cycle of the tufting machine and during one rotational cycle of the cam. Additionally, by means of the adjustable position of the slide block 96, the cyclical speeding up and slowing down of the cam 50 may be selectively varied so that the cam 50 may be rotated at a speed which periodically may be slowed down, stopped or zeroed out, or even a negative speed relative to the imput to the ring gear, the latter resulting in a periodic reversal of the cam. The addition of the oscillating input to the constant input can be visualized in graphic form having velocity as the y-axis and time as the x-axis whereby a sin wave results, the area within the curve during the dwell portion being the distance or amount the cam moves during the dwell. If a negative speed results from the oscillation causing the cam to rotate in the reverse direction during a portion of the dwell the apparatus can actually provide no net movement of the cam during the dwell.

As aforesaid, the amplitude of oscillation of the rocker arm 92 may be adjusted by moving the slide block 96 within the slot 98 of the slide arm 100, thereby providing a means whereby the motion of the sun gear 82, and hence of the cam 50, can be changed to suit particular requirements. In particular, more patterns with a single cam may be available merely by adjusting the position of the slide block to vary the amplitude of oscillation and by changing selective sprockets or pulleys.

In view of the need to effect a longitudinal adjustment of the needle bar while the needles are withdrawn from the backing material, approximately 33 percent, and at the best 50 percent, of the full needle cycle is available for needle bar adjustment and the profile of the cam must be such as to effect the requisite adjustment within this proportion of the machine cycle. In consequence, the cam profile of a sliding needle bar construction driven by conventional drive means is not only steep but also presents a sudden transition from the "dwell" to the "displacement" portions thereof. In the conventional systems, circumstances may give rise to difficulties in providing wholly satisfactory cam profiles, to disadvantagous inertia effects, and to the need to use relatively small diameter cam followers to accomodate the sudden change in cam profile in moving from the "dwell" portion to the "displacement" portion of the cam.

A cam drive constructed according to the present invention not only has the ability to obtain longer pattern repeats with the same cam, thereby permitting larger diameter followers which have more strength and dynamic response, but a longer displacement profile cam is obtainable so that more accurate profiles can be obtained. Furthermore because the cam has better dynamic characteristics, higher shifting speeds are obtainable so that a tufting machine need not be slowed down merely because it has a needle bar shifting mechanism. Additionally, as aforesaid, a single cam may be utilized to obtain additional patterns with the adjustable feature forming one aspect of the invention. It has also been found that because of the better dynamic response, less noise and more accuracy is provided by the needle bar shifting apparatus than in the prior art. For example, because of the accelaration and decelaration characteristics, needle bars driven by prior art shifters "overshoot" the desired locations because of the inertia effects, but the present apparatus provides a system which has slower acceleration and deceleration at the beginning and ending respectively of the shift displacement so that the inertia effects are lower at the end of the shift or displacement of the needle bar thereby providing more accuracy in the pattern produced.

Figure 5:
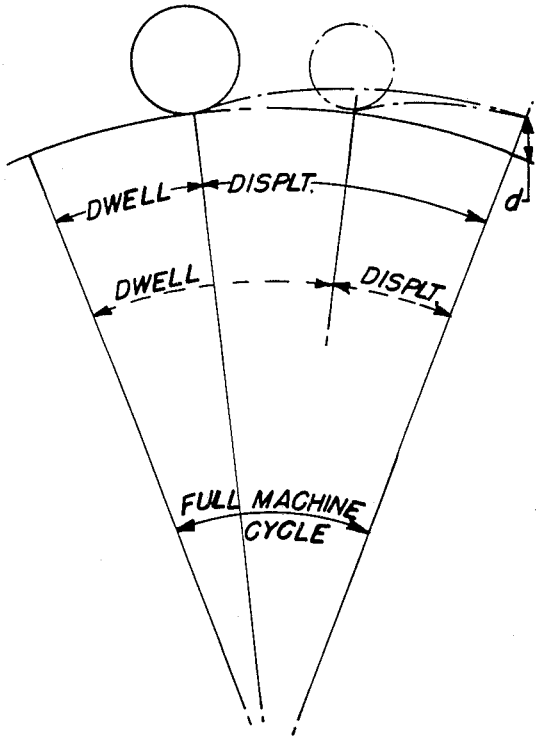
FIG. 5 is a schematic illustration of the cam profiles of a conventional needle bar shifting apparatus and of a shifting apparatus driven by drive means constructed in accordance with the principles of the present invention.

Referring to FIG. 5, the relationship between the "dwell" and "displacement" periods for a cam profile typical of conventional sliding needle bar constructions is illustrated diagrammatically by the broken lines while that provided by the apparatus of the present invention is illustrated by the solid lines. With the variable motion created by the drive mechanism of the present invention, the angular velocity of the cam may be arranged to be minimal while the needles are engaged with the backing material so that only a minor proportion of the cam profile attributable to a single machine cycle is required for the "dwell" and the major portion, for example 66 percent, is available for the "displacement" part of the profile. Accordingly, for a comparable cam, a smooth transition from "dwell" to "displacement" is possible, and for a "displacement" of like magnitude a lesser rate of displacement is required. The smoother transition allows for the use of larger diameter cam followers, such follower being diagrammatically illustrated on the profile of the cam in FIG. 5, while the reduced rate of displacement militates against adverse inertia effects. FIG. 5 illustrates diagrammatically the larger radius transition between the "dwell" and the "displacement" portion of a cam having the same rise "d" for a sliding needle bar drive system constructed in accordance with the principles of the present invention as compared to the smaller radius transition of prior art constructions. Since the radius of transition is larger, the cam follower(s) may be larger thereby providing a system with better dynamic response.

Additionally, as an alternative to taking advantage of the reduced "dwell" portion which results from the present invention for providing a profile of improved quality, the reduction may be used as a means for increasing the number of movements, for example, by a factor of two, which can be effected for each rotation of the cam. If the "displacement" portion of the cam profile is in accord with that of a cam of a conventional system, and the "dwell" portion is materially reduced, each machine cycle would accordingly require a lesser angular part of the cam. For example, since shifting of the needle bar only occurs during the "displacement" portion of the cam profile and is fixed transversely of the direction of the movement of the backing material, the slowing down, stopping, or reversal of the cam during the "dwell" portion permits more stitches to be tufted during the "dwell" portion of the cycle in comparison to that of the prior art.

While the invention is believed to be of particular value in effecting longitudinal adjustment of the sliding needle bar, or indeed of a sliding needle plate, the drive mechanism may have application in other parts of a tufting machine. For example, an analogous arrangement is thought to be of value in the context of backing material take-up, the arrangement being such as to advance the backing material only while the needles are clear of the backing material.

Figure 6:
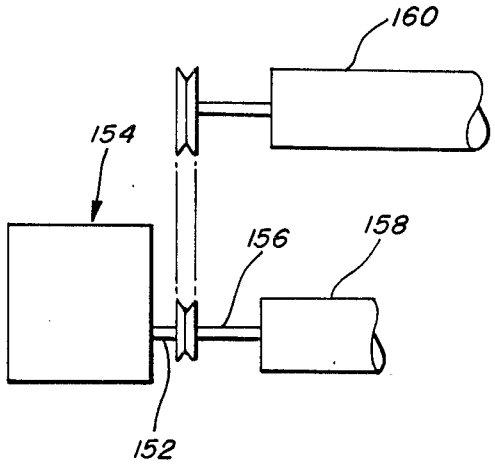
FIG. 6 is a diagrammatic representation of the drive mechanism for driving the backing material take-up rolls.

In the context of the backing material take-up for feeding the backing material through the tufting machine, the drive means 154, illustrated in FIG. 6, is substantially the same as the drive means 54 and has its sun gear mounted on an output shaft 152, the latter being drivably coupled to a shaft 156 on which a take-up roller 158 is mounted. The take-up roller 158 may be drivably connected to the supply side roller 160 in conventional manner. The drive means 154 is driven in timed relationship with the needle bar 26 as described in conjunction with the drive means 54. Thus, the backing material is driven in a cyclically variable manner whenever the needle bar is disposed so that the needles are free of the backing material. By controlling the oscillating motion input to the epicyclic drive means, the backing material may be speeded up or slowed down as desired for various pattern affects.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a reciprocating needle bar carrying a plurality of needles spaced transversely across the machine and adapted to penetrate a base material moving longitudinally across a support plate thereof to insert a plurality of stitches upon each penetration of the base material, mounting means for mounting said needle bar for transverse movement relatively to the base material, a rotatably mounted cam having stitch pattern information for directing the transverse movement of the needle bar, follower means responsive to the stitch pattern information on said cam, means connecting said follower means to said needle bar for selectively shifting said needle bar transversely in accordance with the stich pattern information on said cam, and cam drive means for rotatably driving said cam, said cam drive means comprising apparatus including first input means driven at a substantially constant speed in timed relationship with the reciprocation of said needle bar, second input means driven at a cyclically varying speed in timed relationship with the reciprocation of said needle bar and output means, said apparatus having means for superimposing the varying speed of the second input means onto the speed of the first input means to derive a cyclically variable resultant speed and for driving said output means at said resultant speed in timed relationship with said needle bar, and means operatively connecting said output means to said cam for rotatably driving said cam at a speed which varies during the reciprocating cycle of the needle bar.

2. In a tufting machine as recited in claim 1, wherein said apparatus comprises epicyclic gear means having an annular ring gear, a sun gear mounted on a shaft and disposed within the ring gear for rotation relative thereto, a plurality of planetary gears disposed intermediate said ring gear and said sun gear in meshing relationship therewith, said first input means comprising said ring gear, said second input means comprising oscillating means for driving said planetary gears cyclically relative to said ring gear thereby to rotate said sun gear in a cyclically variable fashion, and whereby said output means comprises said shaft.

3. In a tufting machine as recited in claim 2, wherein said planetary gears are rotatably supported on a carrier, a rocker arm fastened to said carrier, and said oscillating means includes eccentric drive means for oscillating said rocker arm in timed relationship with the reciprocation of said needles.

4. In a tufting machine as recited in claim 3, wherein said eccentric drive means comprises a drive arm rotatable about an axis of rotation and connecting means for connecting said rocker arm to said drive arm at a location spaced from said axis.

5. In a tufting machine as recited in claim 4, wherein said connecting means comprises a connecting rod having one end pivotably connected to said rocker arm and a second end pivotably connected to said drive arm.

6. In a tufting machine as recited in claim 4, wherein said drive arm includes a slot, a slide block disposed within said slot and selectively adjustably positionable therein, said connecting means comprises a connecting rod having one end pivotably connected to said rocker arm and a second end pivotably connected to said slide block.

7. In a tufting machine having a reciprocating needle bar carrying a plurality of needles spaced transversely across the machine, means for reciprocatably driving said needle bar, means for supporting a backing material for penetration by said needles for insertion of a series of tufts of yarn into the backing material upon each penetration thereof, feed means including a rotatably driven feed roller for feeding the backing material longitudinally through the tufting machine in timed relationship with the needles, and feed roller drive means for rotatably driving said feed roller said feed roller drive means comprising apparatus including first input means driven at a substantially constant speed in timed relationship with the reciprocation of said needle bar, second input means driven at a cyclically varying speed in timed relationship with the reciprocation of said needle bar and output means, said apparatus having means for superimposing the varying speed of the second input means at said resultant speed in timed relationship with said needle bar, and means operatively connecting said output means to said feed roller for rotatably driving said feed roller at a speed which varies during the reciprocating cycle of the needle bar.

8. In a tufting machine as recited in claim 7, wherein said apparatus comprises epicyclic gear means having an annular ring gear, a sun gear mounted on a shaft and disposed within the ring gear for rotation relative thereto, a plurality of planetary gears disposed intermediate said ring gear and said sun gear in meshing relationship therewith, said first input means comprising said ring gear, said second input means comprising oscillating means for driving said planetary gears cyclically relative to said ring gear thereby to rotate said sun gear in a cyclically variable fashion, and whereby said output means comprises said shaft.

9. In a tufting machine as recited in claim 8, wherein said planetary gears are rotatably supported on a carrier, a rocker arm fastened to said carrier, and said oscillating means includes eccentric drive means for oscillating said rocker arm in timed relationship with the reciprocation of said needles.

10. In a tufting machine as recited in claim 9, wherein said eccentric drive means comprises a drive arm rotatable about an axis of rotation and connecting means for connecting said rocker arm to said drive arm at a location spaced from said axis.

11. In a tufting machine as recited in claim 10, wherein said connecting means comprises a connecting rod having one end pivotably connected to said rocker arm and a second end pivotably connected to said drive arm.

12. In a tufting machine as recited in claim 11, wherein said drive arm includes a slot, a slide block disposed within said slot and selectively adjustably positionable therein, said connecting means comprises a connecting rod having one end pivotably connected to said rocker arm and a second end pivotably connected to said slide block.

13. In a tufting machine having a reciprocating needle bar carrying a plurality of needles spaced transversely across the machine and adapted to penetrate a base material, feed means including a rotatable feed roller for moving said base material longitudinally across a support plate thereof for receiving a plurality of stitches upon each penetration by said needles, feed roller drive means for rotatably driving said feed roller, mounting means for mounting said needle bar for transverse movement relatively to the base material, a rotatably mounted cam having stitch pattern information for directing the transverse movement of the needle bar, follower means responsive to the stitch pattern information on said cam, means connecting said follower means to said needle bar for selectively shifting said needle bar transversely in accordance with the stitch pattern information on said cam, and cam drive means for rotatably driving said cam, at least one of said cam drive means and said feed roller drive means comprising apparatus including first input means driven at a substantially constant speed in timed relationship with the reciprocation of said needle bar, second input means driven at a cyclically varying speed in timed relationship with the reciprocation of said needle bar and output means, said apparatus having means for superimposing the varying speed of the second input means onto the speed of the first input means to derive a cyclically variable resultant speed and for driving said output means at said resultant speed in timed relationship with said needle bar, and means operatively connecting said output means to at least one of said cam and said feed roller for rotatably driving some at a speed which varies during the reciprocating cycle of the needle bar.

14. In a tufting machine as recited in claim 13, wherein said apparatus comprises epicyclic gear means having an annular ring gear, a sun gear mounted on a shaft and disposed within the ring gear for rotation relative thereto, a plurality of planetary gears disposed intermediate said ring gear and said sun gear in meshing relationship therewith, said first input means comprising said ring gear, said second input means comprising oscillating means for driving said planetary gears cyclically relative to said ring gear thereby to rotate said sun gear in a cyclically variable fashion, and whereby said output means comprises said shaft.

15. In a tufting machine as recited in claim 14, wherein said planetary gears are rotatably supported on a carrier, a rocker arm fastened to said carrier, and said oscillating means includes eccentric drive means for oscillating said rocker arm in timed relationship with the reciprocation of said needles.

16. In a tufting machine as recited in claim 15, wherein said eccentric drive means comprises a drive arm rotatable about an axis of rotation and connecting means for connecting said rocker arm to said drive arm at a location spaced from said axis.

17. In a tufting machine as recited in claim 16, wherein said connecting means comprises a connecting rod having one end pivotably connected to said rocker arm and a second end pivotably connected to said drive arm.

18. In a tufting machine as recited in claim 17, wherein said drive arm includes a slot, a slide block disposed within said slot and selectively adjustably positionable therein, said connecting means comprises a connecting rod having one end pivotably connected to said rocker arm and a second end pivotably connected to said slide block.

* * * * *